United States Patent [19]

Fekete

[11] 3,957,270

[45] May 18, 1976

[54] GAME: WHISPERING STICK

[75] Inventor: Arisztid Z. Fekete, Lakewood, Ohio

[73] Assignee: The Raymond Lee Organization, Inc., New York, N.Y. ; a part interest

[22] Filed: June 24, 1974

[21] Appl. No.: 481,956

[52] U.S. Cl. ..... 273/95 F; 273/102 R; 273/106 R

[51] Int. Cl.[2] ..... A63B 71/02

[58] Field of Search ..... 273/106 R, 95 E, 95 F, 273/95 R, 105 R, 102 R

[56] References Cited

UNITED STATES PATENTS

| | | | |
|---|---|---|---|
| 1,903,539 | 4/1933 | Warner | 273/95 F |
| 1,935,370 | 11/1933 | Nekuda | 273/95 F |
| 3,073,598 | 1/1963 | Tiikkainen | 273/95 F |
| 3,458,196 | 7/1969 | Monzulla | 273/105 R |
| 3,540,734 | 11/1970 | Temple | 273/105 R |

*Primary Examiner*—Richard C. Pinkham
*Assistant Examiner*—Marvin Siskind

[57] ABSTRACT

A hollow cylindrical tube with holes in the wall of the tube is disposed intermediate a pair of like solid conical bodies disposed at opposite ends of the tube in a manner that the vertex of each body points outwardly from the center of the bute, forming a missile. Players hit the missile with clubs towards a goal. The goal is a flexible circular sheet disposed on the ground painted in the form of a bull's-eye with a bucket on top at the central region, the open portion of the bucket facing upwardly.

4 Claims, 5 Drawing Figures

FIG. 1
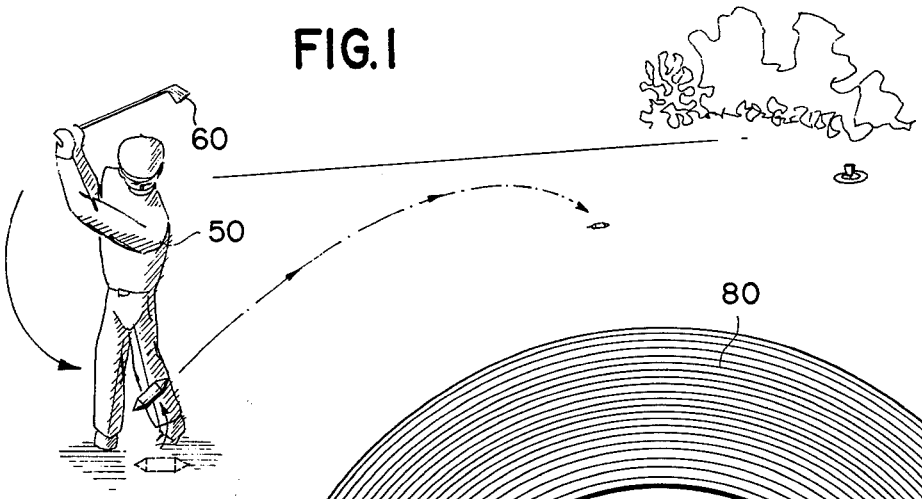
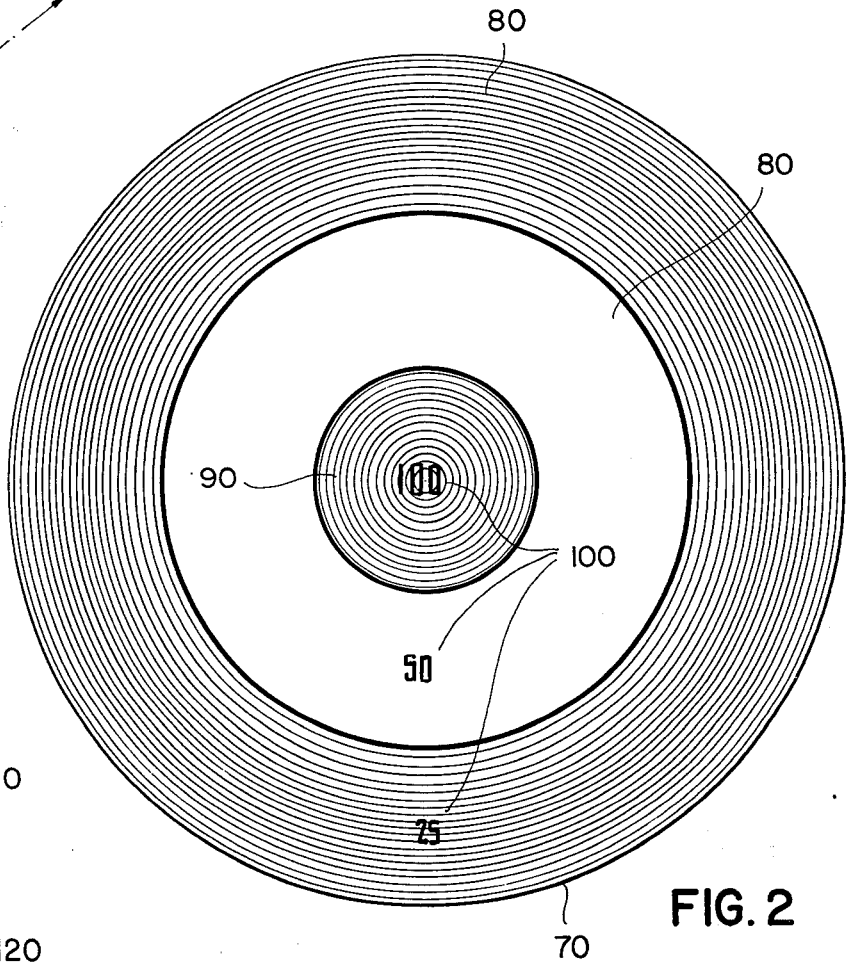
FIG. 2
FIG. 3
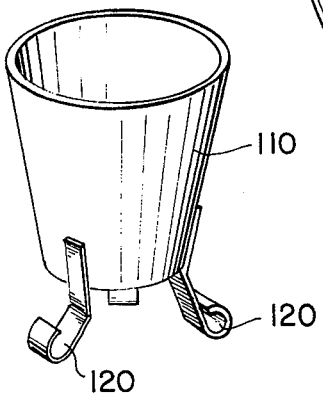
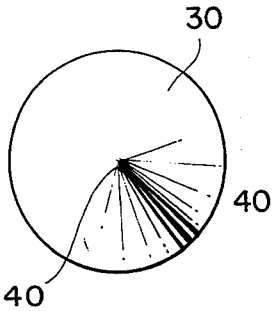
FIG. 4
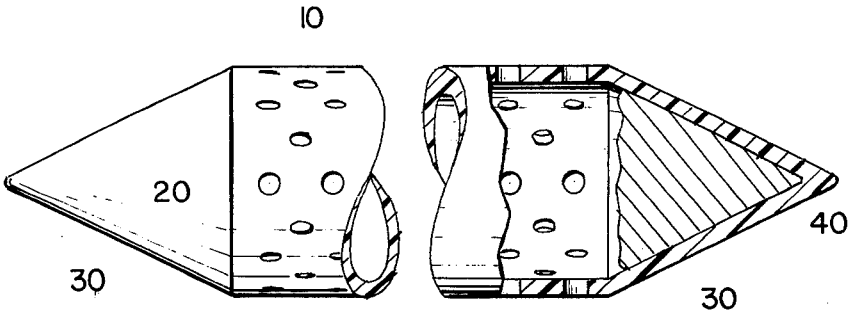
FIG. 5

GAME: WHISPERING STICK

SUMMARY OF THE INVENTION

The invention is directed towards the development of an outdoor game which can be played by one or more people. The game apparatus consists of a missile, a goal and a plurality of clubs. Each player hits the missile into the air with a club and attempts to hit the goal with the missile. In this game, the missile has the novel feature of whistling as it flies through the air.

The missile includes a hollow cylindrical tube disposed between two heavy solid conical bodies. The tube bears a plurality of like holes through its wall, the holes being distributed evenly over the surface of the tube, and the tube bears one of the conical bodies at each end, with the vertices of the bodies directed outwardly from the center of the tube. When the missile is in the air, wind passes through the holes in the tube and causes whistling.

The goal is a circular flexible sheet painted similarly to a bull's-eye which is placed on the ground. A bucket is placed on top of the center of the bull's-eye with its open portion facing upwardly.

BRIEF DESCRIPTION OF THE DRAWINGS

In the drawings:

FIG. 1 shows the missile being hit into the air by a player;

FIG. 2 shows the flexible sheet;

FIG. 3 shows the bucket;

FIG. 4 shows an end view of the missile; and

FIG. 5 shows a side view of the missile.

DETAILED DESCRIPTION OF PREFERRED EMBODIMENTS

Referring now to the drawings, a missile such as is shown in FIG. 5 includes a hollow cylindrical tube 10 with holes 20 extending through the wall of the cylinder and being regularly spaced over the surface of the wall. The tube bears two like heavy solid conical bodies 30 on its opposite ends, the vertices 40 being directed outwardly from the center of the tube. The axis of the tube is coincident with the axes of the bodies 30.

As is shown in FIG. 1, the missile is hit into the air by a player 50 swinging a club 60.

The goal, as is shown in FIG. 2 includes a flexible circular sheet 70 placed on the ground and divided into a three-region bull's-eye, with two outer concentric rings 80 and a central circular region 90. Both the rings and the region 90 are distinctively colored, and both bear a number 100, denoting the numerical value to be scored by a player who hits the goal. A bucket includes an open-topped cup 110 supported by three regularly spaced legs 120 attached to the sides of the cup. The bucket is placed on top of region 90 on the sheet, to provide extra points for a player who propels the missile into the bucket.

While the invention has been described with detailed reference to the drawings, the protection sought is to be limited only by the terms of the claims which follow.

I claim:

1. Outdoor game apparatus adapted to be used by at least one player, said apparatus comprising:

a goal disposed on a section of ground remote from a staring location;

at least one club; and a missile which is to be struck by the club to be propelled toward the goal, said missile including a hollow cylindrical tube having a plurality of holes extending through the tube wall, said holes being regularly distributed, and two like heavy solid conical bodies, each body being secured at its base to a corresponding end of the tube, the vertices of the cones pointing outward from the tube, the axis of the tube and the axes of the bodies being coincident.

2. The apparatus of claim 1 wherein the goal includes a flexible circular sheet with a plurality of concentric rings disposed around a central circular region, with both the rings and the central region bearing various numbers and colors representing their values.

3. The apparatus of claim 2 wherein a bucket is placed on top of the central region with the open portion of the bucket facing upwardly.

4. The apparatus of claim 3 wherein the bucket is supported by three regularly spaced legs attached to the sides of the bucket.

* * * * *